US006047667A

United States Patent [19]

Leppanen et al.

[11] Patent Number: 6,047,667

[45] Date of Patent: Apr. 11, 2000

[54] MOTORCYCLE CAMSHAFT SUPPORT PLATE

[75] Inventors: Robert L. Leppanen, Wauwatosa; Timothy J. Trenkle, Grafton; Jeffrey P. Coughlin, Germantown, all of Wis.

[73] Assignee: Harley-Davidson Motor Company, Milwaukee, Wis.

[21] Appl. No.: 09/121,998

[22] Filed: Jul. 24, 1998

[51] Int. Cl.[7] ..... F01M 11/02

[52] U.S. Cl. ..... 122/196 R

[58] Field of Search ..... 123/196 R, 195 R, 123/195 C, 195 A

[56] References Cited

U.S. PATENT DOCUMENTS

| | | | |
|---|---|---|---|
| 4,703,724 | 11/1987 | Candea et al. | 123/192.2 |
| 5,092,292 | 3/1992 | Iguchi et al. | 123/196 R |
| 5,295,463 | 3/1994 | Wenger et al. | 123/196 R |
| 5,555,856 | 9/1996 | Bauer et al. | 123/41.42 |

OTHER PUBLICATIONS

Uniquely V–Twin Manufacturing 1994 Catalog—p. 4.

*Primary Examiner*—Willis R. Wolfe
*Assistant Examiner*—Jason Benton
*Attorney, Agent, or Firm*—Micheal Best & Friedrich LLP

[57] ABSTRACT

A lubrication system for a motorcycle engine includes a camshaft support plate that is separable from an ornamental cam cover. The camshaft support plate at least partially defines a cam chest of the engine. A crankcase defines a crankcase sump and the cam chest defines a cam chest sump. A divider wall is disposed between the crankcase sump and the cam chest sump to prevent oil from draining from one sump into the other. An oil pump is mounted on the camshaft support plate, with a pressure chamber of the oil pump being at least partially defined by the camshaft support plate. The oil pump independently draws oil from the crankcase sump and the cam chest sump through a split-kidney intake assembly. Oil pumped from the sumps is delivered to a reservoir, and is then drawn back out of the reservoir by the oil pump and delivered to components of the engine through a series of oil passages, some of which are defined by the camshaft support plate.

20 Claims, 6 Drawing Sheets

MOTORCYCLE CAMSHAFT SUPPORT PLATE

FIELD OF THE INVENTION

The present invention relates to internal combustion engines for motorcycles, and more specifically to lubrication systems for motorcycle engines.

BACKGROUND

Prior art motorcycle engines include one or more camshafts that are rotated by a crankshaft through a drive belt, chain, or gear arrangement. Commonly, a cam cover is used both to cover one end of the camshaft, and to support that end of the camshaft for rotation. Therefore, the cam cover is both a functional and ornamental piece.

Prior art motorcycle engines generally include either a dry sump or wet sump lubrication system. In both the wet sump and dry sump lubrication systems, oil is collected in a sump at the bottom of the crankcase after the oil has lubricated various components of the engine. In a dry sump lubrication system, the oil is pumped out of the crankcase sump and into an external oil tank or reservoir before the oil is recirculated to the engine. In a wet sump lubrication system, the oil is either slung from the crankcase sump with an oil slinger, or pumped from the crankcase sump to the components of the engine with an oil pump.

SUMMARY OF THE INVENTION

It has been found that the use of a cam cover as both a functional and ornamental piece poses some disadvantages. Should the ornamental outer surface of the cam cover become scratched or dented, the entire piece would have to be replaced at significant cost. Also, because prior art cam covers serve both functional and ornamental purposes, the ornamental aspect of the cam cover is somewhat dictated or limited by the functional aspect of the cam cover.

In response to the above-identified disadvantages, a motorcycle engine is provided which includes a crankcase, a crankshaft supported for rotation within the crankcase, a cam chest, a camshaft support plate that is separate from the cam cover of the engine, and a camshaft at least partially supported for rotation within the cam chest by the camshaft support plate.

In one aspect of the invention, the camshaft support plate at least partially defines the cam chest. In another aspect of the invention, the camshaft support plate defines at least one oil passage. In another aspect of the invention, an oil pump is mounted on the camshaft support plate, with the camshaft support plate at least partially defining a pressure chamber within the oil pump. In another aspect of the invention, first and second sumps are defined within the engine, and the oil pump has a split-kidney intake allowing the oil pump to draw oil independently from each of the first and second sumps.

The camshaft support plate of the present invention does not serve an ornamental purpose, and does not have to be replaced when the ornamental cam cover is damaged. Additionally, because the ornamental cam cover does not serve a significant functional purpose, the ornamental aspects of the cam cover may be enhanced and modified without regard to the effect of such enhancement or modification on any functional aspect of the piece. A cost savings is created on the manufacturing side of both the functional camshaft support plate and the ornamental cam cover because a defect in one of the pieces does not require the scrapping of the other piece.

DETAILED DESCRIPTION

Figure 1:
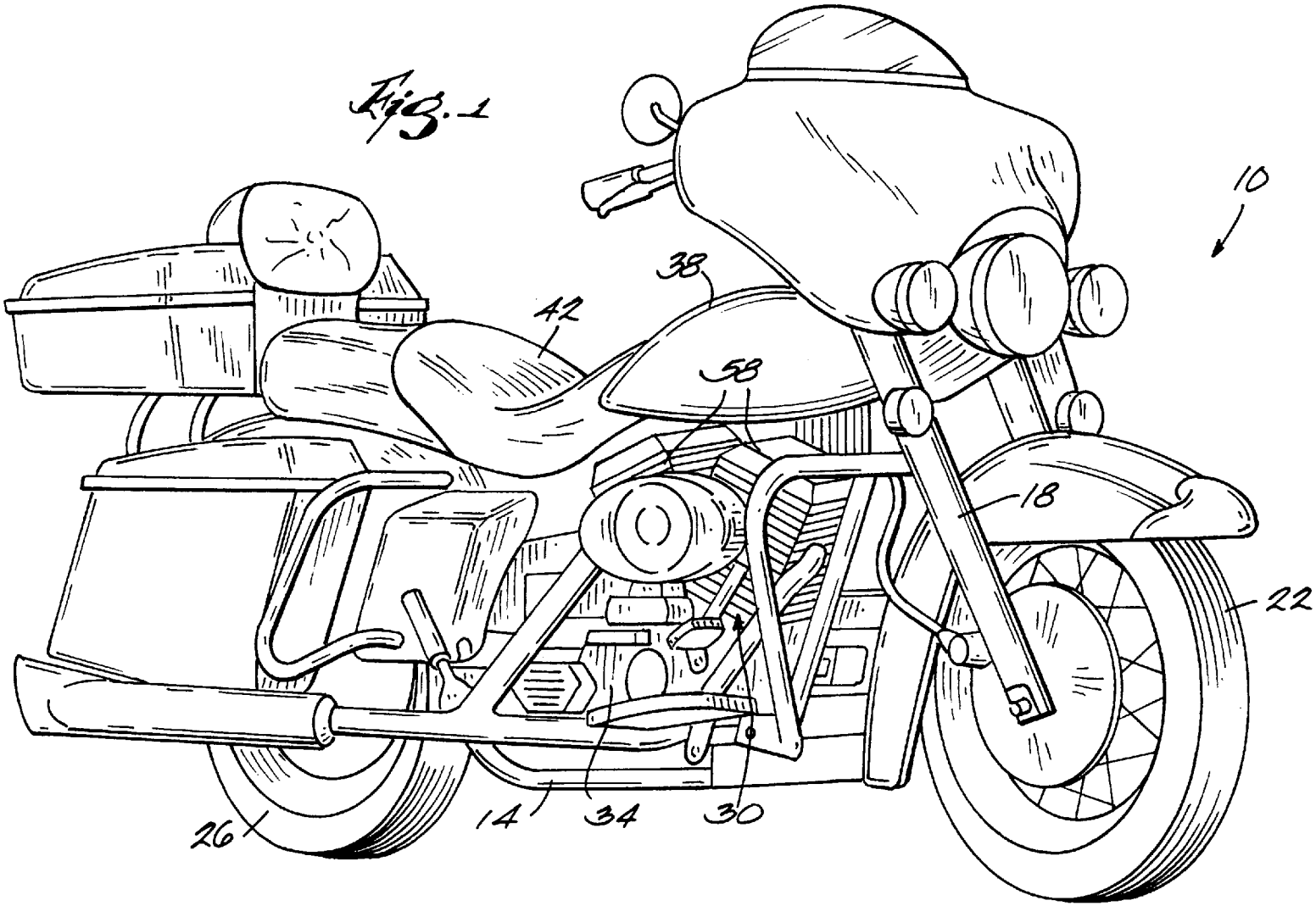
FIG. 1 is a right side perspective view of a motorcycle including the lubrication system of the present invention.

FIG. 1 illustrates a motorcycle 10 having a frame 14. Mounted on the frame 14 are: a front fork assembly 18; a front wheel 22; a rear fork assembly or swing arm (not shown); a rear wheel 26; an engine 30 and a transmission 34 mounted between the front and rear wheels 22, 26; a gas tank 38; and a seat 42.

Figure 5:
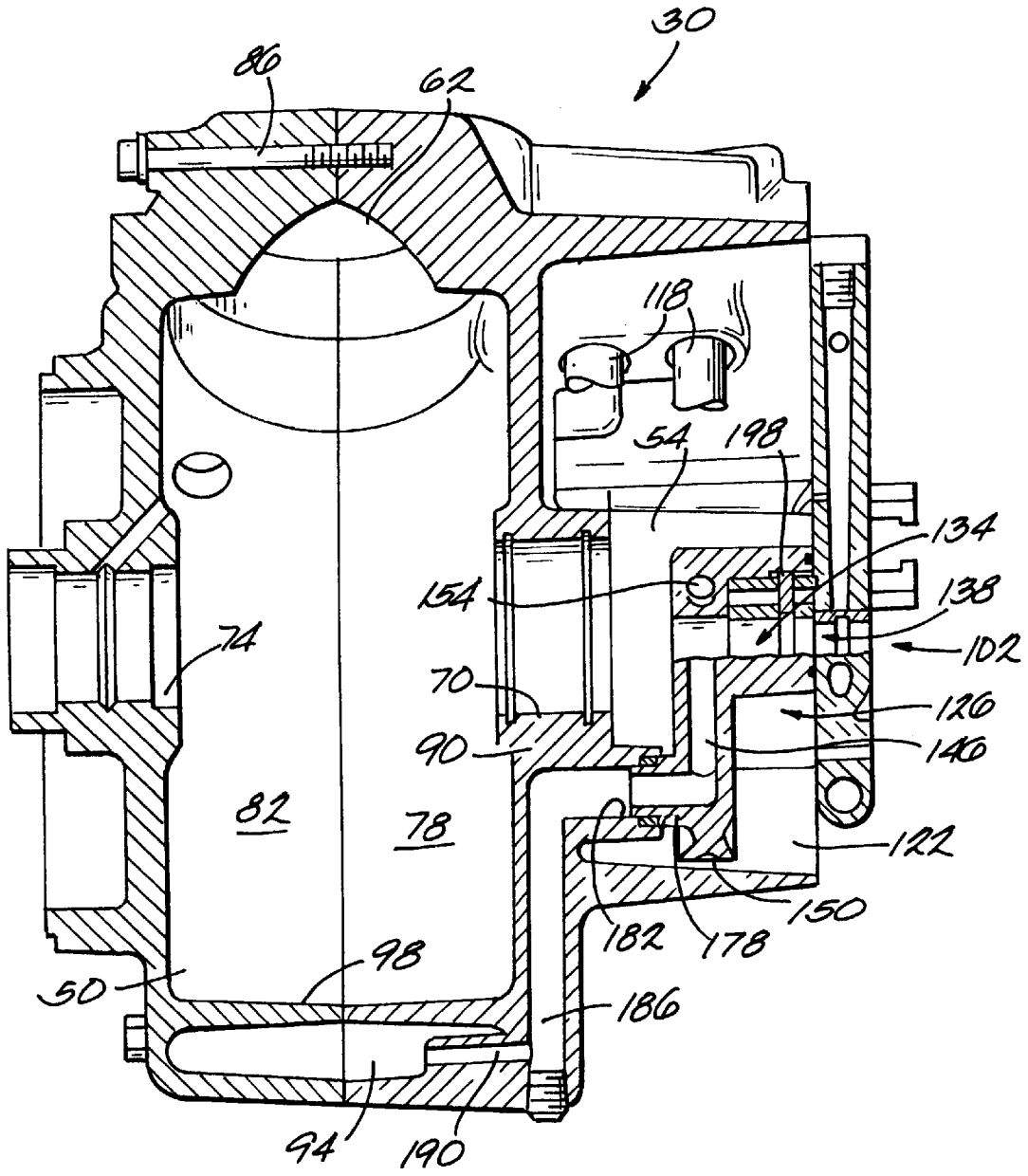
FIG. 5 is a section view of the engine taken along line 5—5 in FIG. 4.

FIGS. 2–5 illustrate the engine 30 in more detail. The engine 30 includes an engine housing 46 generally defining a crankcase 50 and a cam chest 54 (FIG. 5). Mounted above the crankcase 50 are a pair of cylinders 58 (FIG. 1). Each cylinder 58 includes a cylinder bore 62 (FIG. 5) in communication with the crankcase 50 and sized to receive a piston (not shown) for reciprocation therein. Each piston is interconnected to a crankshaft 66 (FIG. 2) that is supported for rotation within the crankcase 50 by right and left end crankshaft bearings 70, 74 (FIG. 5). A connecting rod (not shown) is connected to each piston at a wrist pin bearing, and to the crankshaft 66 at a crankpin bearing. The pistons reciprocate within the cylinder bores 62 in reaction to rotation of the crankshaft 66.

Referring to FIG. 5, the crankcase 50 comprises a right half 78 and a left half 82 that are joined with fasteners 86. The right half 78 of the crankcase 50 includes a dividing wall 90 that separates the crankcase 50 from the cam chest 54. A crankcase sump 94 is provided at the bottom of the crankcase 50, and a drain plate 98 covers the portion of the crankcase sump 94 directly below the crankshaft axis of rotation. Oil draining from the crankshaft 66 and other components in the crankcase 50 collects in the crankcase sump 94 when the engine 30 is in the normal operating position shown in FIG. 5.

Figure 2:
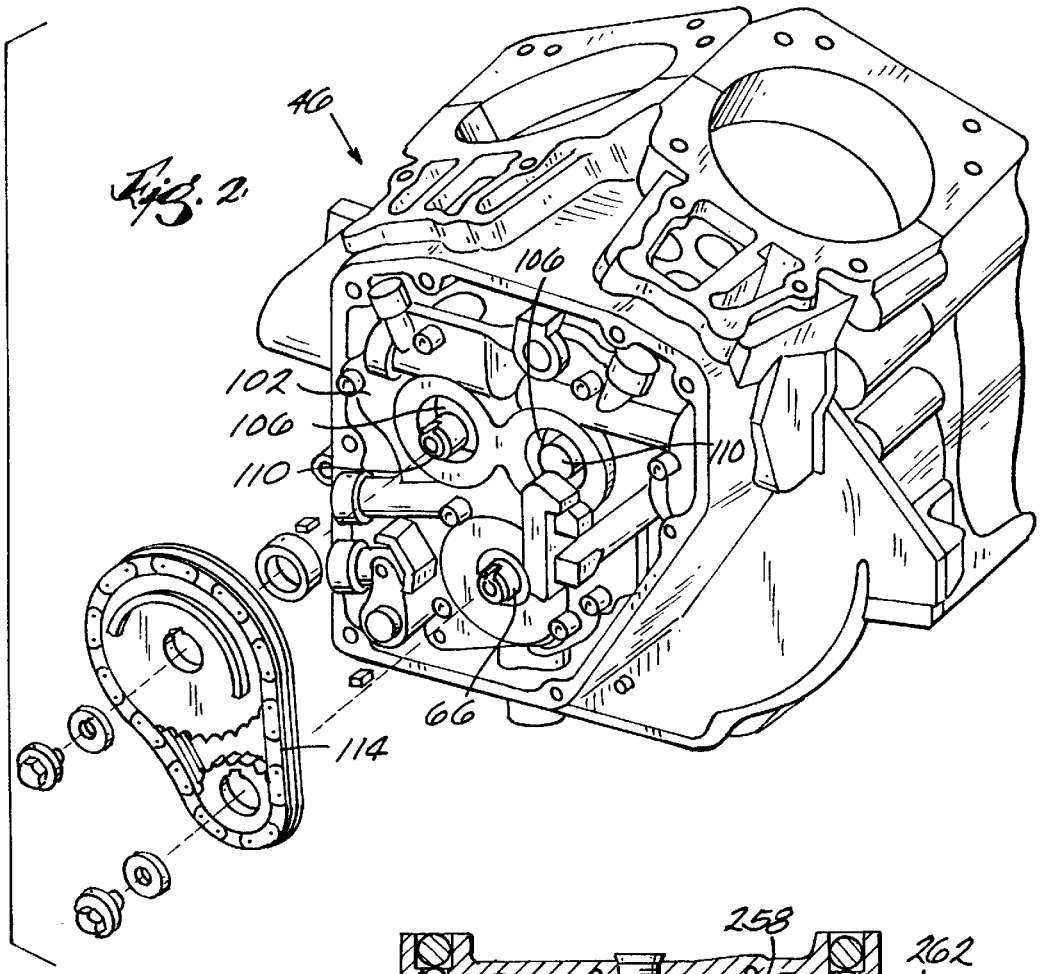
FIG. 2 is a partially exploded view of the right side of a portion of the engine.
Figure 3:
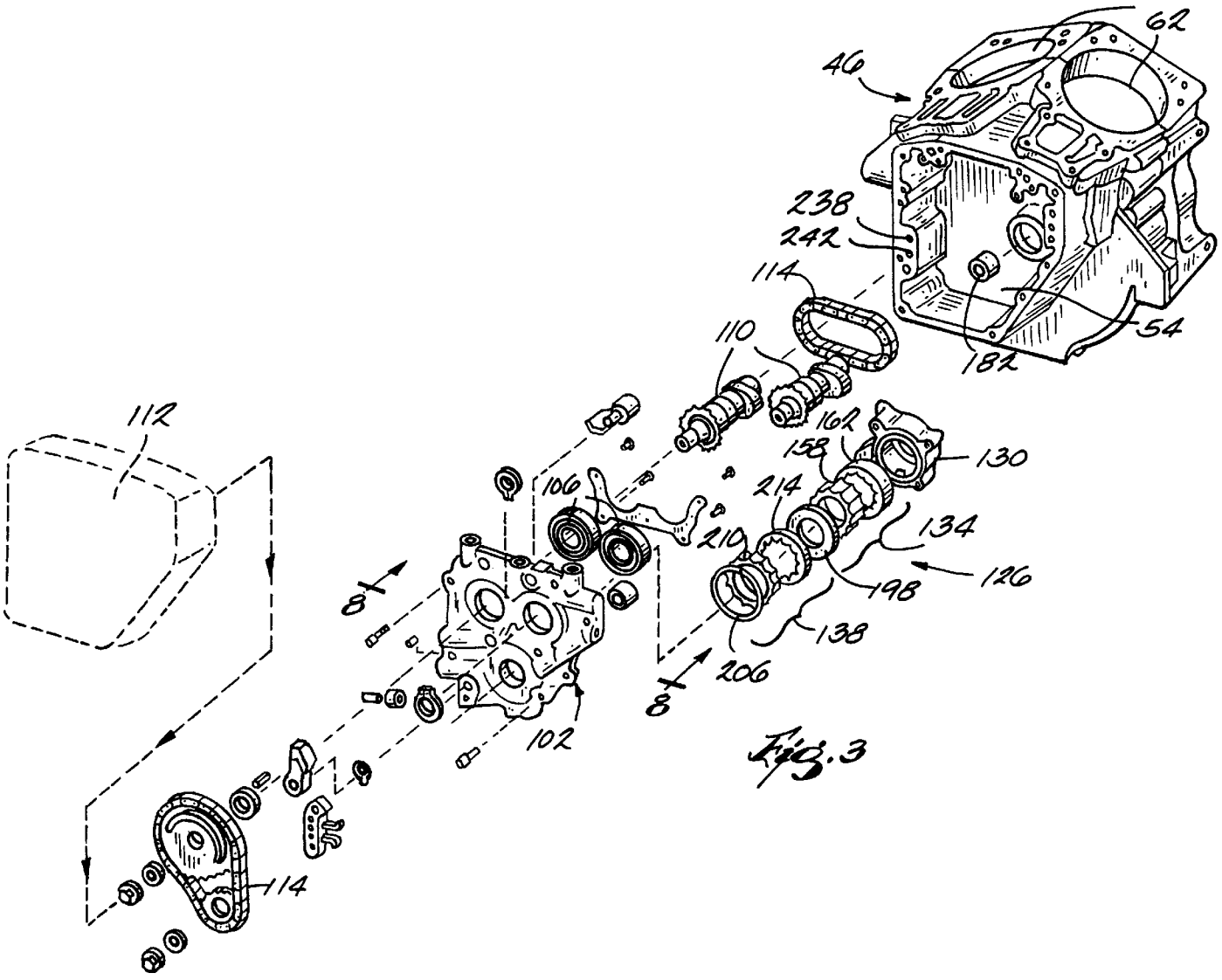
FIG. 3 is an exploded view of the right side of a portion of the engine.
Figure 4:
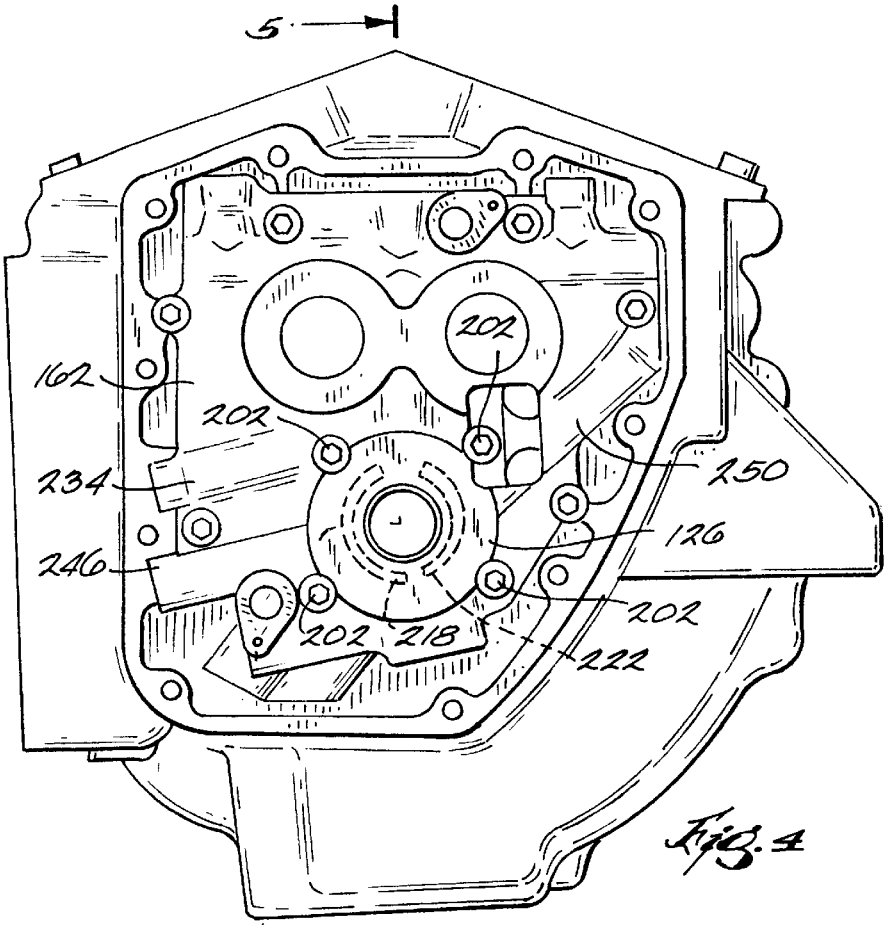
FIG. 4 is a right side elevational view of the engine.

The cam chest 54 is defined between the dividing wall 90 and a camshaft support plate 102. A cam cover 112 (shown in broken lines in FIG. 3) covers the camshaft support plate 102 but does not support the cam shafts 110. The camshaft support plate 102 includes two camshaft bearings 106 (FIG. 3) for supporting the right end of each of two camshafts 110 (FIGS. 2 and 3). The camshafts 110 are coupled to the crankshaft 66 in a conventional manner by way of drive belts or chains 114 (FIGS. 2 and 3), and rotate within the cam chest 54 at half the speed of the crankshaft 66. Cam lobes on the camshafts 110 actuate lifters 118 (FIG. 5) to cause the push rods 120 (FIG. 9) to reciprocate. The push rods 120 actuate rockers and valves (not shown) in a conventional manner. The crankshaft 66 extends through the cam chest 54 and through the camshaft support plate 102.

Referring to FIG. 5, the bottom of the cam chest 54 defines a cam chest sump 122 where oil draining from the camshafts 110 and other components in the cam chest 54 collects. Oil contained in the cam chest sump 122 is prevented from flowing directly into the crankcase 50 and the crankcase sump 94 by the divider wall 90.

An oil pump 126 having a pump housing 130 is also provided. The illustrated oil pump 126 is a gerotor pump having a scavenging side 134 and a supply side 138 as shown in FIGS. 3 and 5. Gerotor pumps generally include a gerotor gear having external teeth and disposed within a gerotor ring having internal teeth. An intake kidney is provided immediately adjacent the gerotor gear and gerotor ring, allowing oil to be drawn into the gerotor pump as the gerotor gear rotates with respect to the gerotor ring. A discharge kidney is also provided that allows oil to pass out of the gerotor pump in reaction to the gerotor gear rotating with respect to the gerotor ring. Gerotor pumps are available from Nichols Portland Corporation of Portland, Me.

Figure 7:
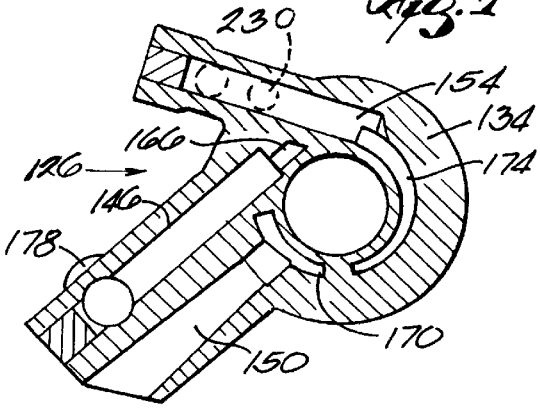
FIG. 7 is a section view of the oil pump taken along line 7—7 in FIG. 6.

The scavenging side 134, as shown in FIGS. 3, 5, and 7, includes a scavenging pressure chamber, a crankcase intake port 146, a cam chest intake port 150, a discharge port 154, a gerotor gear 158, and a gerotor ring 162. A first scavenging intake aperture or kidney 166 is in communication between the crankcase intake port 146 and the scavenging pressure chamber. A second scavenging intake aperture or kidney 170 is in communication between the cam chest intake port 150 and the scavenging pressure chamber. A scavenging discharge aperture or kidney 174 is in communication between the scavenging pressure chamber and the discharge port 154. Each of the first and second intake kidneys 166, 170 and the discharge kidney 174 are disposed immediately adjacent the scavenging gerotor gear and ring 158, 162. This ensures that, for each rotation of the gerotor gear 158, oil is independently drawn from both the crankcase sump 94 and the cam chest sump 122.

Figure 6:
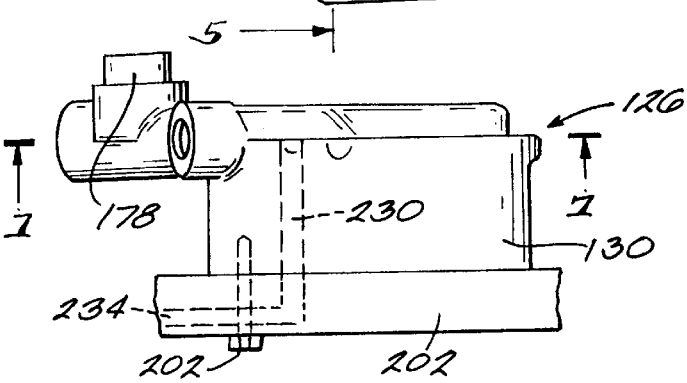
FIG. 6 is top view of the oil pump mounted on the camshaft support plate.

A boss 178 (FIG. 6) is provided on the crankcase intake port 146, and is received in a fitting 182 formed in the divider wall 90 (FIG. 5). A crankcase scavenging passage 186 extends from the bottom of the crankcase 50 to the fitting 182. The crankcase scavenging passage 186 has an inner diameter ranging from about 8 mm to about 11 mm. A narrow return passage 190, having an inner diameter of about 5 mm is in fluid communication between the crankcase sump 94 and the crankcase scavenging passage 186. The narrow return passage 190 limits the amount of oil that can pass from the crankcase sump 94 to the oil pump 126. In this regard, the narrow return passage 190 has a damping effect on pressure pulses created within the crankcase 50 by the pistons reciprocating in the cylinder bores 62. Thus, the crankcase sump 94 is in fluid communication with the oil pump 126 through the narrow return passage 190, the crankcase scavenging passage 186, and the fitting 182 in the divider wall 90, to thereby facilitate scavenging oil from the crankcase 50.

The cam chest intake port 150 extends down to the cam chest sump 122. In the illustrated embodiment, there is about ¼ inch clearance between the bottom of the cam chest 54 and the end of the cam chest intake port 150. The cam chest intake port 150 is therefore able to draw oil directly from the cam chest sump 122.

The scavenge gerotor gear 158 is fixed to an end of the crankshaft 66 for rotation therewith. The scavenge gerotor gear 158 rotates within the gerotor ring 162 within the scavenging pressure chamber. This rotation causes reduced or negative pressure over the first and second scavenge intake kidneys 166, 170, causing oil to be drawn from the crankcase sump 94 and the cam chest sump 122, respectively. Because each of the first and second scavenging intake kidneys are separately exposed to the lower pressure in the scavenge pressure chamber, the pump will not follow the path of least resistance and draw oil from only one of the sumps. This so-called split-kidney configuration therefore ensures that oil is drawn from both the crankcase sump and the cam chest sump for each rotation of the gerotor gear.

The rotation also causes increased or positive pressure within the pressure chamber to discharge oil through the scavenge discharge kidney 174 and out the discharge port 154. After the oil is discharged from the oil pump 126, the oil returns to an external oil reservoir or oil tank 194 (FIG. 9).

As seen in FIGS. 3 and 5, the supply side 138 of the pump 126 includes a supply pressure chamber separated from the scavenging pressure chamber by a separator plate 198. The oil pump 126 is mounted on the camshaft support plate 102 with fasteners 202, causing the supply side of the pump 126 to press against the camshaft support plate 102 with a sealing member 206, such as an O-ring, therebetween. Thus, the camshaft support plate 102 partially defines the supply pressure chamber.

The supply side 138 of the pump 126 includes a supply gear 210 and a ring or collar 214 that are similar to the components on the scavenging side 134. A supply intake aperture or kidney 218 (FIG. 4) and a supply discharge aperture or kidney 222 are defined in the camshaft support plate 102, each communicating with the supply pressure chamber. Oil that has been cooled and de-aerated in the oil reservoir 194 is drawn into the supply side 138 of the pump 126 through the supply intake kidney 218. In a similar manner as described above with respect to the scavenging side 134 of the pump 126, reduced or negative pressure is created in the half of the supply pressure chamber over the supply intake kidney 218 to draw oil into the supply pressure chamber. Increased or positive pressure is applied to the oil over the supply discharge kidney 222 to discharge oil therethrough. The camshaft support plate 102, therefore, not only supports a bearing for each camshaft 110, but also partially defines the supply pressure chamber and provides oil passages through which oil flows to and from the engine 30.

Figure 9:
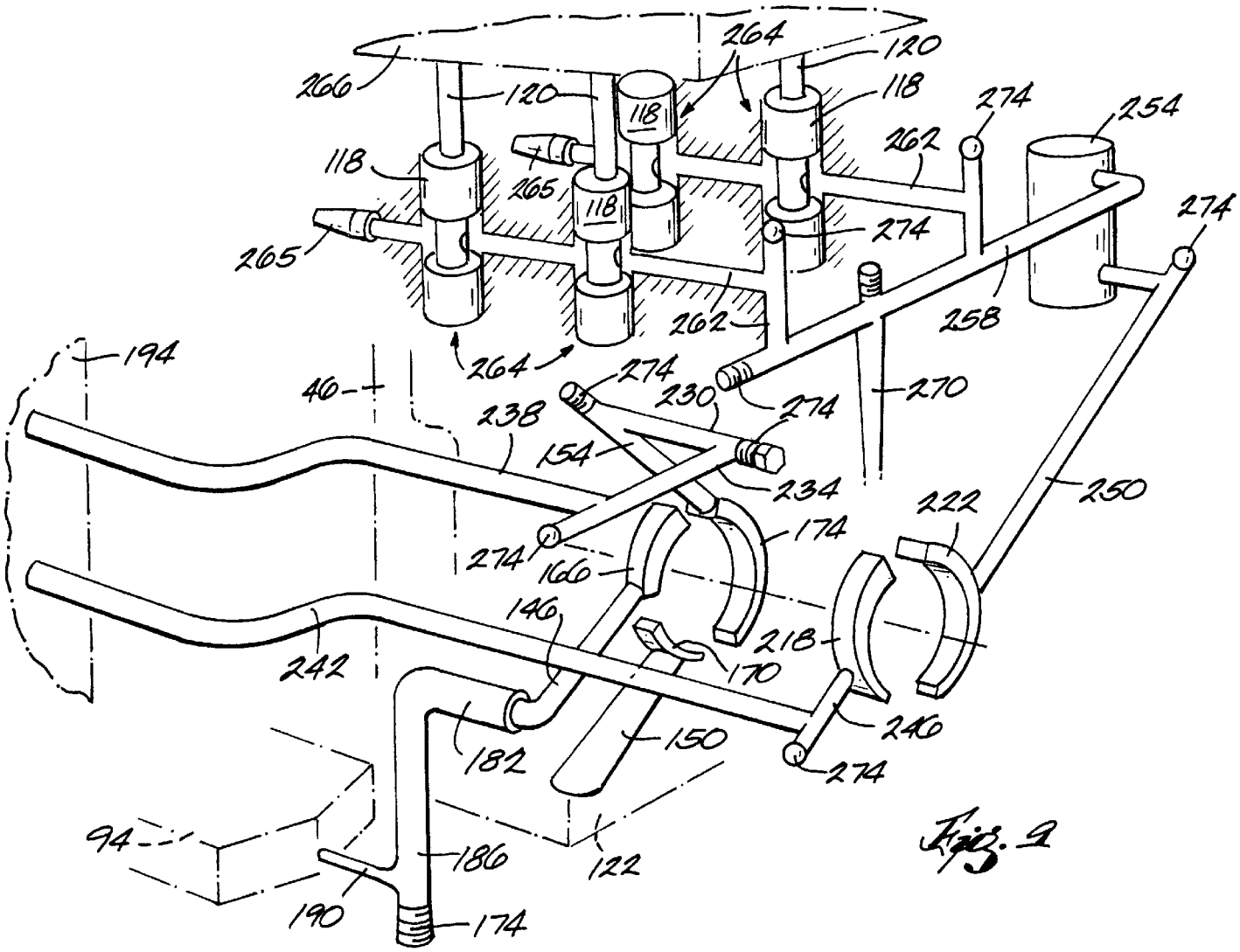
FIG. 9 is a perspective schematic view of the lubrication system of the engine.

The oil path is best illustrated in FIG. 9. In operation, oil that has lubricated various components of the engine drains into either the crankcase sump 94 or the cam chest sump 122. In reaction to negative pressure in the scavenging side 134 of the oil pump 126, oil in the crankcase sump 94 is drawn through the narrow return passage 190, up the crankcase scavenging passage 186, through the fitting 182 in the divider wall, and into the crankcase intake port 146 of the oil pump 126. Oil in the cam chest sump 122 is drawn into the cam chest intake port 150 in reaction to negative pressure created in the scavenging pressure chamber. The oil then enters the scavenge pressure chamber through the first and second intake kidneys 166, 170.

The oil is discharged from the scavenging side of the oil pump 134 through the discharge kidney 174 and the discharge port 154 in reaction to positive pressure in the scavenging pressure chamber. From the discharge port 154, the oil travels through a passage 230 (FIGS. 6, 8, and 9) in the oil pump 126 (FIGS. 6 and 9) and into a passage 234 (FIGS. 6, 8, and 9) formed in the camshaft support plate 102.

The passage 234 extends to an edge of the camshaft support plate 102, where the oil is diverted into a passage 238 (FIGS. 3 and 9) formed in the engine housing 46, and is directed into an external oil reservoir 194.

Figure 8:
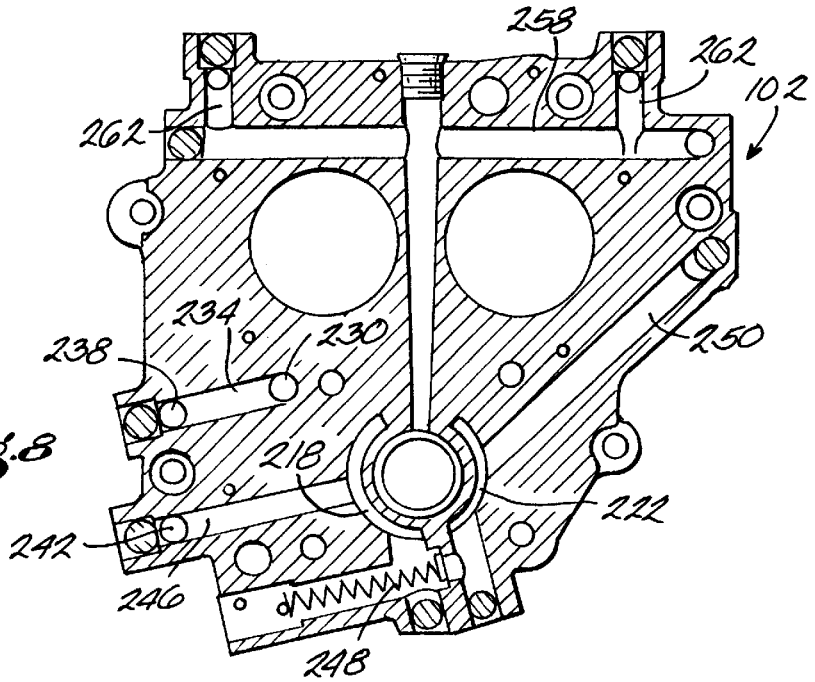
FIG. 8 is a section view of the camshaft support plate taken along line 8—8 in FIG. 3.

The oil is cooled and de-aerated in the oil reservoir 194, and then drawn from the oil reservoir 194 through a return passage 242 (FIGS. 3 and 9) formed in the engine housing 46 in response to negative pressure created in the supply side 138 of the oil pump 126. The return passage 242 is in communication with a return passage 246 (FIGS. 4, 8, and 9) formed in the camshaft support plate 102. The return passage 246 in the camshaft support plate 102 communicates with the supply pressure chamber through the supply intake kidney 218 (FIGS. 8 and 9).

Oil that has been drawn into the supply pressure chamber is discharged through the supply discharge kidney 222. A by-pass valve 248 feeds excess oil back to the supply intake kidney 218 to maintain the pressure in the system at about 35 psi. A supply passage 250 (FIGS. 4, 8, and 9) is formed in the camshaft support plate 102, and is in fluid communication with an oil filter 254. The oil passes through the oil filter 254, and then re-enters the camshaft support plate 102 through a top passage 258. The top passage 258 is in fluid communication with passages 262 that communicate with a pair of lifter sets 264 housing the lifters 118, and piston cooling oil jets 265. Oil passes through the lifters 118 to the push rods 120 and up to the rocker boxes 266, where the rockers and valves are lubricated.

A vertical passage 270 is also formed in the camshaft support plate 102, which runs downwardly from the top passage 258 to the crankshaft 66. The crankshaft 66 is lubricated, and oil passes into a drilled hole (not shown) in the crankshaft 66 that is in fluid communication with the crankpin bearing. Oil draining from the crankpin bearing is slung within the crankcase 50 by the crankshaft 66 to lubricate other bearings in the crankcase 66 and the wrist pin bearing of the piston. The oil then drains back to the crankcase and cam chest sumps 94, 122.

The various oil passages formed in the camshaft support plate 102, engine housing 46, and oil pump 126, are cast in place or formed by drilling into the cast part. At various points, plugs 274, such as screw plugs or ball plugs are inserted into the passage to close holes created in the cast part.

Although particular embodiments of the present invention have been shown and described, other alternative embodiments will be apparent to those skilled in the art and are within the intended scope of the present invention. Thus, the present invention is to be limited only by the following claims.

It is claimed:

1. A motorcycle engine comprising:

a crankcase;

a crankshaft supported for rotation within said crankcase;

a cam chest;

a camshaft supported for rotation with said cam chest, said camshaft being driven by said crankshaft;

a camshaft support plate having a camshaft bearing supporting an end of said camshaft; and a cam cover interconnected to and separable from said cam chest, and at least partially covering an end of said camshaft and a portion of said camshaft support plate.

2. The motorcycle engine of claim 1, further comprising an oil pump and an oil reservoir, wherein said camshaft support plate defines an oil passage.

3. The motorcycle engine of claim 2, wherein said oil passage is a scavenging discharge passage allowing oil to flow from said oil pump to said oil reservoir.

4. The motorcycle engine of claim 2, wherein said oil passage is a supply intake passage allowing oil to flow from said oil reservoir to said oil pump.

5. The motorcycle engine of claim 2, wherein said oil passage is a supply discharge passage allowing oil to flow from said oil pump to said engine.

6. The motorcycle engine of claim 1, wherein said camshaft support plate at least partially defines said cam chest.

7. The motorcycle engine of claim 1, further comprising:

a first sump disposed in said crankcase and adapted to contain oil;

a second sump disposed within said cam chest and adapted to contain oil; and a divider wall preventing oil contained in one of said first and second sumps from draining into the other of said first and second sumps.

8. The motorcycle engine of claim 1, further comprising an oil pump having a pressure chamber at least partially defined by said camshaft support plate.

9. The motorcycle engine of claim 8, wherein said camshaft support plate defines at least one pump kidney.

10. The motorcycle engine of claim 8, wherein said pump is a gerotor pump fastened to said camshaft support plate.

11. The motorcycle engine of claim 8, further comprising:

a first sump disposed in said crankcase and adapted to contain oil;

a second sump disposed within said cam chest and adapted to contain oil; and a divider wall preventing oil contained in one of said first and second sumps from draining into the other of said first and second sumps.

12. The motorcycle engine of claim 11, further comprising:

a first scavenging passage in communication between said first sump and said pump; and a second scavenging passage in communication between said second sump and said pump.

13. A motorcycle engine comprising:

a crankcase;

a crankshaft supported for rotation within said crankcase;

a cam chest;

a camshaft supported for rotation with said cam chest, said camshaft being driven by said crankshaft;

a camshaft support plate having a camshaft bearing supporting an end of said camshaft; and an oil pump having a pressure chamber at least partially defined by said cam shaft support plate.

14. The motorcycle engine of claim 13, wherein said camshaft support plate defines at least one pump kidney.

15. The motorcycle engine of claim 13, wherein said camshaft support plate defines at least one oil passage.

16. A motorcycle comprising:

a frame;

front and rear wheels rotatably coupled to said frame; and an engine coupled to said frame, said engine including:

a crankcase, a crankshaft supported for rotation within said crankcase, a cam chest, a camshaft supported for rotation with said cam chest, said camshaft being driven by said crankshaft, a camshaft support plate having a camshaft bearing supporting an end of said camshaft, and a cam cover interconnected to and separable form said cam chest, and at least partially covering an end of said camshaft and a portion of said camshaft support plate.

17. The motorcycle of claim 16, wherein said engine further includes an oil pump and an oil reservoir, wherein said camshaft support plate defines an oil passage.

18. The motorcycle of claim 16, wherein said camshaft support plate at least partially defines said cam chest.

19. The motorcycle of claim 16, wherein said engine further includes:

a first stamp disposed in said crankcase and adapted to contain oil, a second sump disposed within said cam chest and adapted to contain oil, and a divider wall preventing oil contained in one of said first and second sumps from draining into the other of said first and second sumps.

20. The motorcycle engine of claim 16, wherein said engine further includes an oil pump having a pressure chamber at least partially defined by said camshaft support plate.

* * * * *

UNITED STATES PATENT AND TRADEMARK OFFICE

CERTIFICATE OF CORRECTION

PATENT NO. : 6,047,667

DATED : April 11, 2000

INVENTOR(S) : Robert L. Leppanen, et. al.

It is certified that error appears in the above-identified patent and that said Letters Patent is hereby corrected as shown below:

Claim 16, Column 7, line 3, "form" should be --from--.

Claim 19, Column 8, line 1, "stamp" should be --sump--.

Signed and Sealed this

Twenty-sixth Day of December, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 6,047,667
DATED : April 11, 2000
INVENTOR(S) : Leppanen et al.

It is certified that error appears in the above-identified patent and that said Letters Patent is hereby corrected as shown below:

Title page,
Item [75], Inventors, should read -- Robert L. Leppanen, Wauwatosa; Timothy J. Trenkle, Grafton; Jeffrey P. Coughlin; Henry M. Hubbard, Menomonee; all of WI. (US) --

Signed and Sealed this

Eleventh Day of January, 2005

JON W. DUDAS
*Director of the United States Patent and Trademark Office*